US010269553B2

(12) United States Patent
Neate et al.

(10) Patent No.: US 10,269,553 B2
(45) Date of Patent: Apr. 23, 2019

(54) LIGHT SOURCE

(71) Applicant: CERAVISION LIMITED, Buckinghamshire (GB)

(72) Inventors: Andrew Simon Neate, Buckinghamshire (GB); Edward Charles Odell, Buckinghamshire (GB); John Stocks, Yorkshire (GB)

(73) Assignee: Ceravision Limited, Milton Keynes (GB)

( * ) Notice: Subject to any disclaimer, the term of this patent is extended or adjusted under 35 U.S.C. 154(b) by 0 days.

(21) Appl. No.: 15/318,567

(22) PCT Filed: Jun. 12, 2015

(86) PCT No.: PCT/GB2015/051731
§ 371 (c)(1),
(2) Date: Dec. 13, 2016

(87) PCT Pub. No.: WO2015/189632
PCT Pub. Date: Dec. 17, 2015

(65) Prior Publication Data

US 2017/0125236 A1 May 4, 2017

(30) Foreign Application Priority Data

Jun. 13, 2014 (GB) ..... 1410669.4

(51) Int. Cl.
*H01J 65/04* (2006.01)
*H01J 61/30* (2006.01)
*H01J 61/33* (2006.01)

(52) U.S. Cl.
CPC ..... *H01J 65/044* (2013.01); *H01J 61/302* (2013.01); *H01J 61/33* (2013.01)

(58) Field of Classification Search
CPC ..... H01J 61/302; H01J 65/044
See application file for complete search history.

(56) References Cited

U.S. PATENT DOCUMENTS

| | | | | |
|---|---|---|---|---|
| 5,844,376 | A | 12/1998 | Lapatovich | |
| 2011/0148293 | A1 | 6/2011 | Hafidi | |
| 2012/0293067 | A1* | 11/2012 | Neate | H01Q 1/26 315/34 |

FOREIGN PATENT DOCUMENTS

| | | |
|---|---|---|
| WO | 2005/015607 | 2/2005 |
| WO | 2006/129102 | 12/2006 |
| WO | 2010/055275 | 5/2010 |
| WO | 2013/004988 | 1/2013 |

* cited by examiner

*Primary Examiner* — Nimeshkumar Patel
*Assistant Examiner* — Jacob R Stern
(74) *Attorney, Agent, or Firm* — Bay State IP, LLC

(57) ABSTRACT

A light source to be powered by microwave energy, having a dielectric body or fabrication of material lucent for exit of light therefrom, a receptacle within the dielectric body or fabrication, and a lucent microwave-enclosing Faraday cage surrounding the dielectric body or fabrication. The dielectric body or fabrication within the Faraday cage forms at least part of a microwave resonant cavity. A sealed plasma enclosure of lucent material within the receptacle has a means for locating the plasma enclosure within the receptacle with respect to the dielectric body or fabrication.

14 Claims, 2 Drawing Sheets

LIGHT SOURCE

CROSS REFERENCE TO RELATED APPLICATION

This application is for entry into the U.S. National Phase under § 371 for International Application No. PCT/GB2015/051731 having an international filing date of Jun. 12, 2015, and from which priority is claimed under all applicable sections of Title 35 of the United States Code including, but not limited to, Sections 120, 363, and 365(c), and which in turn claims priority under 35 USC 119 to Great Britain Patent Application No. 1410669.4 filed on Jun. 13, 2014.

The present invention relates to a light source for a microwave-powered lamp.

It is known to excite a discharge in a capsule with a view to producing light. Typical examples are sodium discharge lamps and fluorescent tube lamps. The latter use mercury vapour, which produces ultraviolet radiation. In turn, this excites fluorescent powder to produce light. Such lamps are more efficient in terms of lumens of light emitted per watt of electricity consumed than tungsten filament lamps. However, they still suffer the disadvantage of requiring electrodes within the capsule. Since these carry the current required for the discharge, they degrade and ultimately fail.

We have developed electrodeless bulb lamps, as shown in our patent application Nos. PCT/GB2006/002018 for a lamp (our "'2018 lamp"), PCT/GB2005/005080 for a bulb for the lamp and PCT/GB2007/001935 for a matching circuit for a microwave-powered lamp. These all relate to lamps operating electrodelessly by use of microwave energy to stimulate light emitting plasma in the bulbs. Earlier proposals involving use of an airwave for coupling the microwave energy into a bulb have been made for instance by Fusion Lighting Corporation as in their U.S. Pat. No. 5,334,913. If an air wave guide is used, the lamp is bulky, because the physical size of the wave guide is a fraction of the wave length of the microwaves in air. This is not a problem for street lighting for instance but renders this type of light unsuitable for many applications. For this reason, our '2018 lamp uses a dielectric wave-guide, which substantially reduces the wave length at the operating frequency of 2.4 Ghz. This lamp is suitable for use in domestic appliances such as rear projection television.

In our European Patent No. EP2188829—Our '829 Patent, there is described and claimed (as granted):

A light source to be powered by microwave energy, the source having:
- a body having a sealed void therein,
  - a microwave-enclosing Faraday cage surrounding the body,
- the body within the Faraday cage being a resonant waveguide,
- a fill in the void of material excitable by microwave energy to form a light emitting plasma therein, and
- an antenna arranged within the body for transmitting plasma-inducing, microwave energy to the fill, the antenna having:
  - a connection extending outside the body for coupling to a source of microwave energy;

wherein:
- the body is a solid plasma crucible of material which is lucent for exit of light therefrom, and
- the Faraday cage is at least partially light transmitting for light exit from the plasma crucible, the arrangement being such that light from a plasma in the void can pass through the plasma crucible and radiate from it via the cage.

As used in Our '829 Patent:

"lucent" means that the material, of the item which is described as lucent, is transparent or translucent—this meaning is also used in the present specification in respect of its invention;

"plasma crucible" means a closed body enclosing a plasma, the latter being in the void when the void's fill is excited by microwave energy from the antenna.

We describe the technology protected by Our '829 Patent as our "LER" technology.

There are certain alternatives to the LER technology, the principal one of which is known as the Clam Shell and is the subject of our International Patent Application No PCT/GB08/003811 ("Our 811 Application"). This describes and claims (as published):

A lamp comprising:
- a lucent waveguide of solid dielectric material having:
  - a bulb cavity,
  - an antenna re-entrant and
  - an at least partially light transmitting Faraday cage and
- a bulb having a microwave excitable fill, the bulb being received in the bulb cavity.

In our International Patent Application No PCT/GB2010/001922 ("Our 922 Application"), there is described and claimed a light source to be powered by microwave energy, the source having:
- a dielectric body of material which is lucent for exit of light therefrom,
- a void within the dielectric body,
- a microwave-enclosing Faraday cage surrounding the dielectric body,
- the dielectric body within the Faraday cage providing a microwave resonant cavity,
- a sealed plasma enclosure of lucent material within the void within the dielectric body,
- means for locating the plasma enclosure within the void with respect to the dielectric body,
- a fill, sealed in the plasma enclosure, of material excitable by microwave energy to form a light emitting plasma, and
- an antenna extending within the Faraday cage for transmitting plasma-inducing, microwave energy to the fill, the antenna having:
- a connection extending outside the body for coupling to a source of microwave energy.

It should be noted that the term "void" in Our 922 Application is used in the same sense as "bulb cavity" in Our 811 Application. This was for good reason, but to avoid confusion, we point out that we use "receptacle" herein in the sense of the cavity of the Our 811 Application, without implication one way or the other as to whether the receptacle is open at one, the other or both ends.

The object of the present invention is to provide an improved a light source to be powered by microwave energy.

According to the invention there is provided a light source to be powered by microwave energy, the source having:
- a dielectric body or fabrication of material which is lucent for exit of light therefrom,
  - a receptacle within the dielectric body or fabrication,
- a lucent, microwave-enclosing Faraday cage surrounding the dielectric body or fabrication, the dielectric body or fabrication within the Faraday cage forming at least part of a microwave resonant cavity, a sealed plasma enclosure of lucent material within the receptacle within the dielectric body or fabrication, means for locating the plasma enclosure within the receptacle with respect to the dielectric body or fabrication, wherein the means for locating the plasma enclosure comprises:

one or more recesses in the body or fabrication at the receptacle and one or more complementary formations on the enclosure, the arrangement being such that in use the formation(s) engage in the recess(es) and maintain the enclosure centred in the receptacle with a regular air gap there between.

Normally, both the body or fabrication and the enclosure will of the same material, preferably quartz.

Preferably the sealed plasma enclosure is formed of drawn quartz tube, drawing of the tube providing a smooth internal bore.

The tube can be sealed to enclose excitable material in the enclosure in accordance with our European Patent No. 1831916.

The tube can be sealed hemi-spherically at the diameter of the tube. In the preferred embodiment, one end is sealed with a boss of smaller diameter. This is the end having the formations.

The formations are preferably a pair of thin strands of quartz fused in a pair of opposite arcs to the tube. Alternatively a single strand extending for more than half way around the tube can be used. Indeed it can be envisaged that a single strand could extend fully around the enclosure.

The recess(es) in the body, where a single body is used, can be formed by mechanical machining. Where the recesses are in a hollow fabrication of quartz walls, they could be formed by glass working techniques.

To help understanding of the invention, two specific embodiments thereof will now be described by way of example and with reference to the accompanying drawings, in which.

Figure 1:
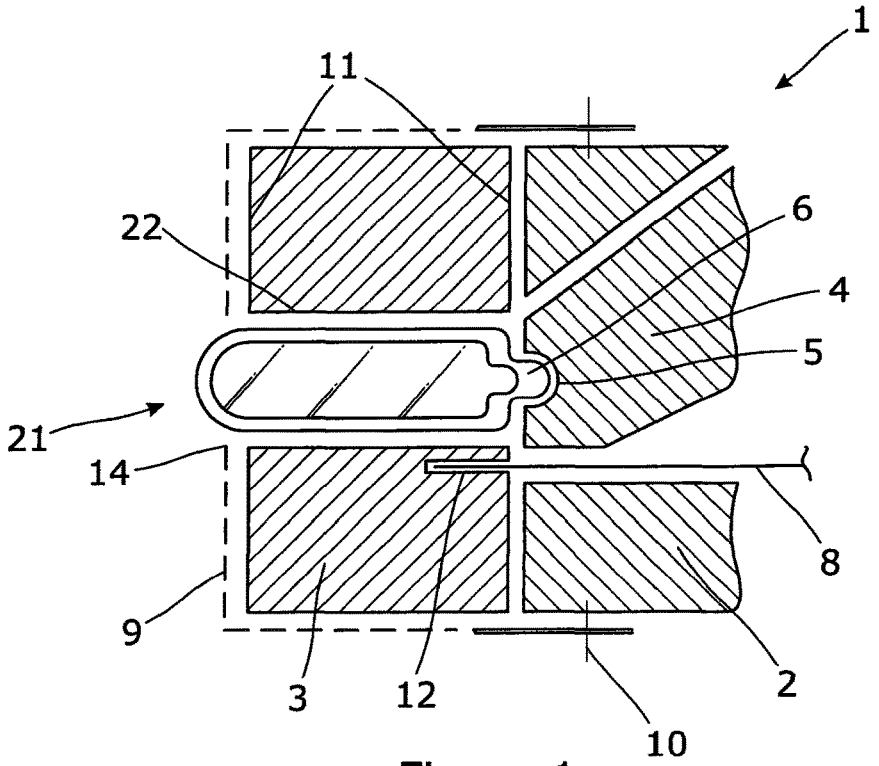
FIG. 1 is a cross-sectional view of a light source of the invention on one central longitudinal plane.
Figure 2:
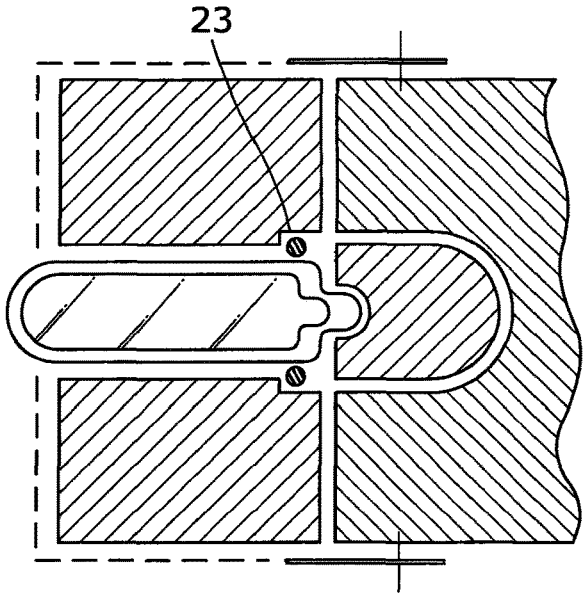
FIG. 2 is a similar view on an orthogonal central plane.
Figure 3:
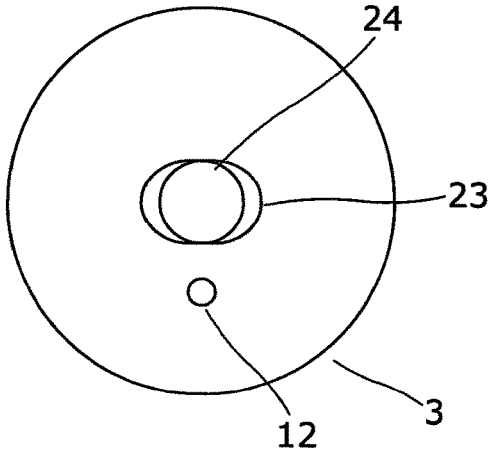
FIG. 3 is a rear view of the crucible of the FIG. 1 light source.
Figure 4:
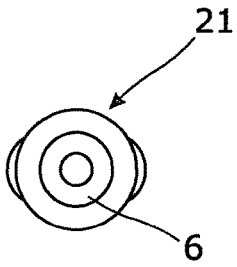
FIG. 4 is a corresponding rear view of the capsule of the FIG. 1 light source.
Figure 5:
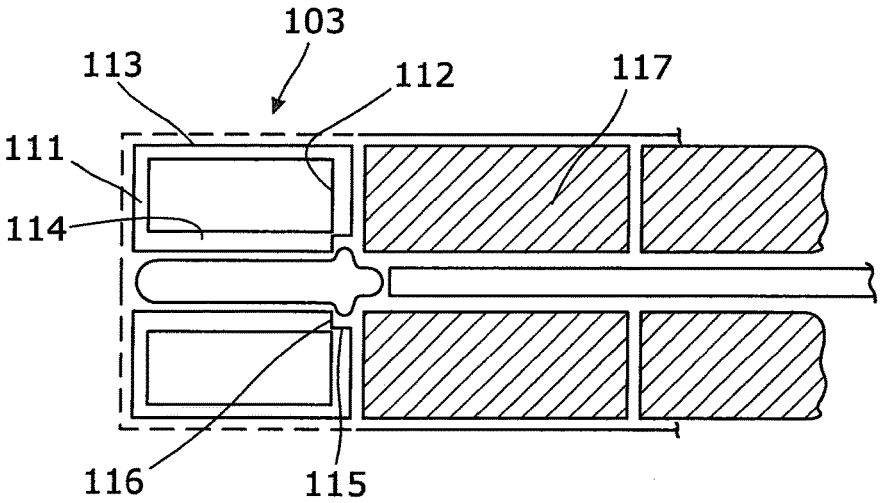
FIG. 5 is a view similar to FIG. 1 of a second embodiment of a light source of the invention.

Referring to FIGS. 1 to 4 of the drawings, a light source 1 has a base 2 for supporting a lucent crucible 3. The base is of round aluminium having a ceramic insert 4 in it. The insert has an indent 5 for an end 6 of an enclosure/bulb/capsule 21 and a bore through which a microwave transmitting antenna 8 extends. A mesh Faraday cage 9 surrounds the crucible in contact with it and is screwed 10 to the base, thereby holding the crucible on the base. These features are in accordance with our current production, except that at present the crucible is fabricated to have a central, sealed, excitable-material-containing void.

The crucible is of fused quartz, 20 mm long between end flats 11 and 49 mm in diameter.

In accordance with the invention, we provide the loose capsule or bulb 21 received in a central receptacle 22 in the crucible. Our conventional excitable material void in a bulb was of the order of 4 mm internal diameter, which corresponds in embodiments where it was of tube fabricated into the crucible, to a 6 mm outside diameter. We have referred to such a thing as a bulb. In so far as the capsule 21 is of 10 mm outside diameter, we prefer to call it a capsule.

The central receptacle is a nominal 10 mm bore, polished out to a 10.6 mm to provide a 0.3 mm air gap all round with the 10 mm OD capsule centred in the bore. On either side of the receptacle a pair of half moon recesses 23 are machined at opposite sides of the inner orifice 24 of the receptacle. They extend 2 mm in from their end flat and 2 mm radially. Their extent is approximately 75°. They are equally angularly spaced with respect to a bore 12 in the crucible for the antenna (and one of them would intercept the bore if they were not so spaced.)

The capsule has a length at 10 mm diameter substantially equal in length to the 20 mm thickness of the capsule. Its front end is domed and the Faraday cage has a central aperture 14 to accommodate its slight protrusion. At the opposite end it has the 7 mm domed end to be received in the indent 5. At the full 10 mm diameter, immediately inwards of this dome, it has two 1 mm diameter, 5 mm long strands of quartz partially-circumferentially fused on around opposite sectors of the tube. These formations fit in the half moon recesses and locate the capsule both longitudinally and centrally in the receptacle, to establish the nominal 0.3 mm clearance between the capsule and the receptacle. When the capsule, crucible and Faraday cage are all assembled to the base, the strands are held bottomed in the recesses.

In a second embodiment, the crucible is replaced by a quartz fabrication 103, having front and back walls 111,112, a circumferential wall 113. A central tube 114 is provided to form a receptacle for a capsule. The walls and tube are fused together. The back wall has an aperture 115, oversize with respect to the bore of the receptacle tube 114, to provide an annular recess 116 for the formations of the enclosure. The fabrication has a lower volume average dielectric constant than the solid crucible, but this is compensated for by a back-up piece of alumina 117 through which an antenna extends centrally.

The invention is not intended to be restricted to the details of the above described embodiments. For instance, where a continuous recess such as the recess 116 is provided, the enclosure formation can be continuous as for instance a 360° ring of fused on strand or a small upset of the capsule material.

The invention claimed is:

1. A light source to be powered by microwave energy, the source having:

a dielectric body or fabrication of material which is lucent for exit of light therefrom, a receptacle within the dielectric body or fabrication, a lucent, microwave-enclosing Faraday cage surrounding the dielectric body or fabrication, the dielectric body or fabrication within the Faraday cage forming at least part of a microwave resonant cavity, a sealed plasma enclosure of lucent material within the receptacle within the dielectric body or fabrication, means for locating the plasma enclosure within the receptacle with respect to the dielectric body or fabrication, wherein the means for locating the plasma enclosure comprises:

one or more radially extending recesses in the body or fabrication at the receptacle and one or more complementary radially extending formations on the enclosure, the arrangement being such that in use the formation(s) engage in the recess(es) and maintain the enclosure centred in the receptacle with a regular air gap therebetween.

2. A light source according to claim 1, wherein the dielectric body is formed of a single piece of lucent material.

3. A light source according to claim 2, wherein the receptacle is formed by a through bore.

4. A light source according to claim 1, wherein the dielectric body is formed by a front wall, a back wall and a circumferential wall, the light source further comprising a backing disc adjacent the back wall.

5. A light source according to claim 4, wherein the receptacle is formed by a tube fused to the front wall at a first end and the back wall at a second end.

6. A light source according to claim 1, wherein the plasma enclosure is formed of a drawn tube.

7. A light according to claim 6, wherein the tube is sealed hemispherically at the diameter of the tube.

8. A light source according to claim 1, wherein the dielectric body and the plasma enclosure are fabricated of the same material.

9. A light source according to claim 6, wherein the material is quartz.

10. A light source according to claim 1, wherein the formation is a strand of material extending longitudinally around the plasma enclosure.

11. A light source according to claim 1, wherein the recess is a pair of opposing longitudinal recesses in the receptacle.

12. A light source according to claim 11, wherein the formation is a pair of opposing longitudinal strands of material fused to the plasma enclosure.

13. A light source according to claim 10, wherein the strand is the same material as that of the enclosure.

14. A light source according to claim 1, wherein on either side of the receptacle a pair of half moon recesses are machined at opposite sides of the inner orifice of the receptacle.

* * * * *